United States Patent [19]

Johnson

[11] 4,279,198

[45] Jul. 21, 1981

[54] REFUSE COMPACTOR SLIDE BEARING

[75] Inventor: Milton J. Johnson, Stanford, KY

[73] Assignee: Whirlpool Corporation, Benton Harbor, Mich.

[21] Appl. No.: 97,737

[22] Filed: Nov. 26, 1979

[51] Int. Cl.[3] ..... B30B 15/04

[52] U.S. Cl. ..... 100/229 A; 308/3.6

[58] Field of Search ..... 100/240, 245, 229, 214 A; 308/3 A, 3 B, 3 R, 3.6; 312/350

[56] References Cited

U.S. PATENT DOCUMENTS

| | | | |
|---|---|---|---|
| 2,835,539 | 5/1958 | Conrad | 308/3.6 X |
| 3,456,808 | 7/1969 | Bridenstine | 308/3.6 X |
| 3,572,874 | 3/1971 | Hassel | 312/350 |
| 3,643,589 | 2/1972 | Carter | 100/245 X |
| 3,786,744 | 1/1974 | Miller | 100/229 A |
| 3,839,954 | 10/1974 | Bourgeois | 10/229 A |
| 3,862,595 | 1/1975 | Longo | 100/229 A |
| 3,888,444 | 6/1975 | Yindra | 308/3 R |
| 3,965,814 | 6/1976 | Manko | 100/214 |
| 4,088,378 | 5/1978 | Pallant | 308/3 R |

FOREIGN PATENT DOCUMENTS

| | | | |
|---|---|---|---|
| 1436031 | 5/1976 | United Kingdom | 308/3 R |

*Primary Examiner*—Billy J. Wilhite

*Attorney, Agent, or Firm*—Wegner, Stellman, McCord, Wood & Dalton

[57] ABSTRACT

A refuse compactor slide bearing for use in guiding the movement of the compactor ram along suitable guides to and from a compacting position within the compactor. The slide bearings are formed as one-piece elements having angularly related slide portions for slidably engaging corresponding angularly related portions of the ram guide means. The bearing slide portions may be formed as tongues resiliently connected to a base portion of the bearing by resilient connecting portions. The tongues are arranged to extend in a direction parallel to that defined by movement of the ram. The tongues may have different slide surface areas and configurations coordinated with the force transfer requirements. One of the slide portions includes a third tongue extending in the direction of movement of the ram toward the compacting position. Cooperating snap fastening means may be provided on the bearing on the ram assembly.

20 Claims, 8 Drawing Figures

FIG. 1
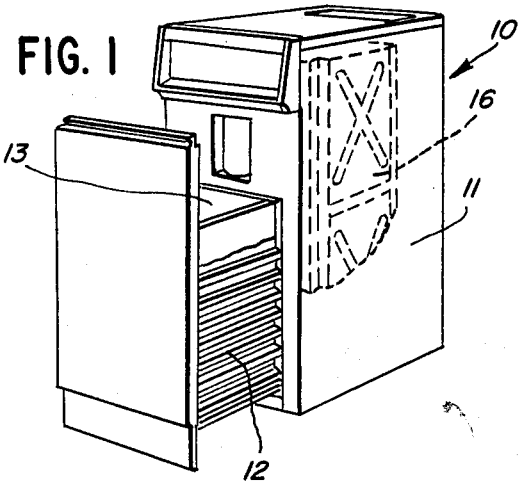
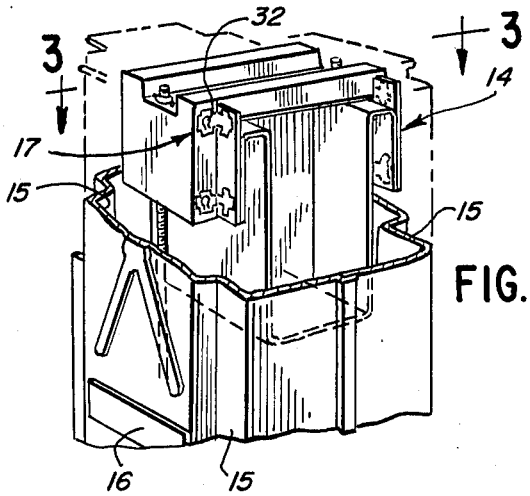
FIG. 2
FIG. 3
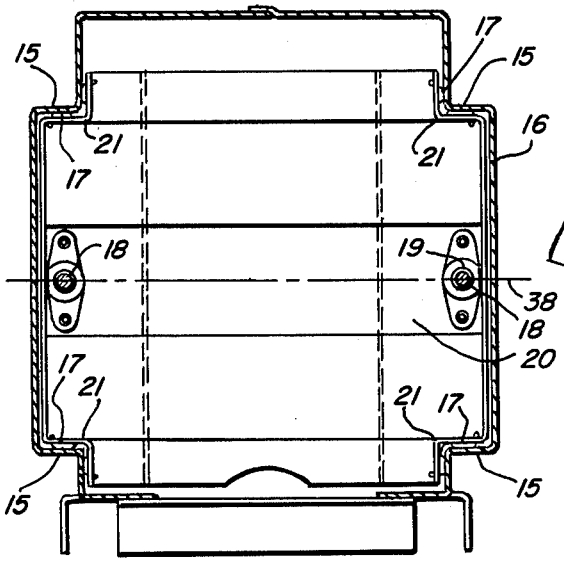
FIG. 4
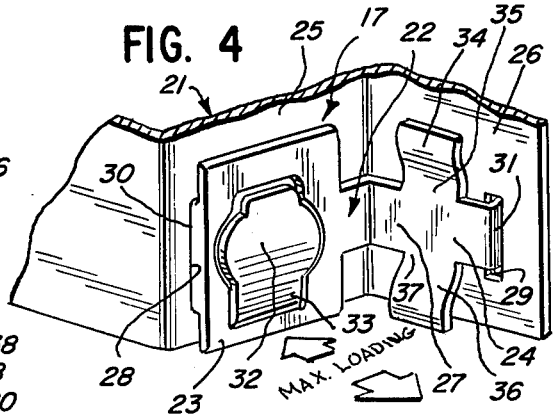
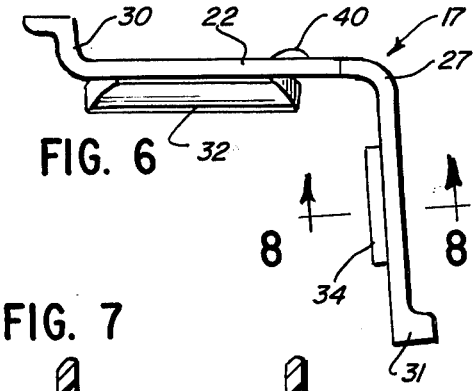
FIG. 6
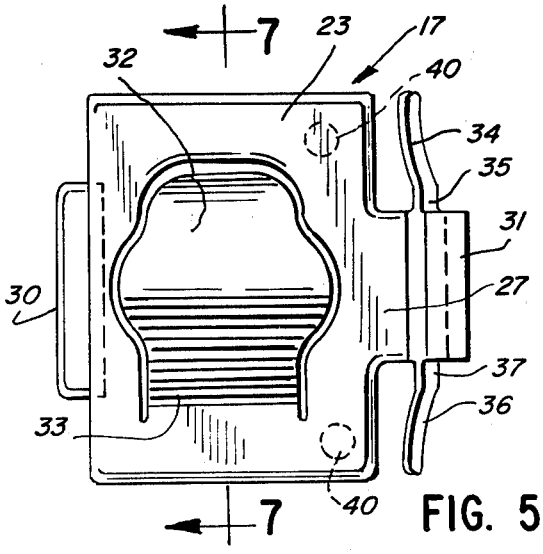
FIG. 5
FIG. 7
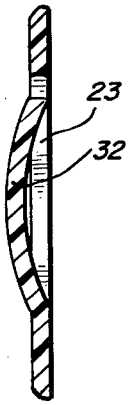
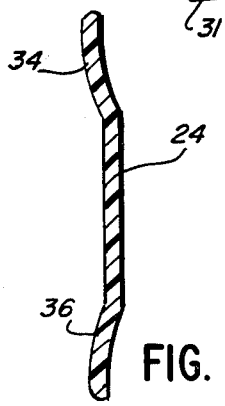
FIG. 8

REFUSE COMPACTOR SLIDE BEARING

BACKGROUND OF THE INVENTION

1. Field of the Invention

This invention relates to slide bearings and in particular to slide bearings for use in refuse compactors and the like.

2. Description of the Prior Art

In U.S. Pat. No. 3,786,744 of Frank E. Miller et al, which patent is owned by the assignee hereof, a refuse compactor support structure is shown wherein the ram assembly is guided for vertical reciprocal movement toward and from the compacting position within the compactor on suitable angular guide portions of the sheet metal frame.

In a number of prior art cabinet structures, wear pieces have been utilized to provide means for facilitating sliding of one element thereof relative to another.

Joseph F. Longo, in U.S. Pat. No. 3,862,595, shows a refuse compactor provided with glide members secured to the upper and lower extremeties of the ram carriage.

U.S. Pat. No. 3,888,444 of Leonard J. Yindra et al, shows a pedestal table support column provided with vertically elongated bearing strips having protruding edge surfaces engaging a corner of the guide column. The flat face of the strip is in surface engagement with an outer surface of an inner column member.

Nicholas L. Manko shows, in U.S. Pat. No. 3,965,814, a baling press having a bolster that carries L-section wear strips.

Joseph Pallant et al disclose, in U.S. Pat. No. 4,088,378, the use of nylon friction pads in a sliding track mechanism. The pads may include an upwardly projecting tongue to hold flanges of the guide channel against the underside of the slide member. In the assembled arrangement, the flanges are disengaged from the slide member to facilitate sliding.

U.S. Pat. No. 3,572,874 of Ernst Hassel shows use of turned wearing pieces on the upper and lower edges of a sliding drawer.

SUMMARY OF THE INVENTION

The present invention comprehends an improved slide bearing for use in refuse compactors and the like to provide facilitated sliding movement of a movable member on suitable guides.

The slide bearing comprises a one-piece element having a base portion provided with a pair of angularly related legs each of which is provided with a tongue projecting from a resilient connection to the base portion so as to be offset, the tongue on the angularly related legs being offset toward a common space defined by the legs.

In the illustrated embodiment, the legs extend substantially at right angles to each other.

In the use of the slide bearing in a refuse compactor wherein the ram is reciprocally mounted for movement along guides toward and from a compacting position within the compactor, the slide bearings are arranged so as to dispose the tongues in a direction extending along, or parallel to, the direction of ram movement.

The invention further comprehends the provision of a second tongue on at least one of the legs extending oppositely to the first tongue thereon.

The invention further comprehends the provision of the tongues on the different legs to define different facial slide surface areas. More specifically the invention comprehends the provision of a tongue having a relatively large surface area to be mounted on the ram assembly so as to accommodate relatively large forces generated in one direction transverse to the ram movement. The area of the tongue on the other leg illustratively is less than the area on the first described leg so as to be correlated with the lesser forces generated thereagainst in the operation of the ram on the guides.

In the illustrated embodiment, the larger area tongue has a width transverse to the direction of movement of the ram substantially greater than the width of the tongue of the other leg.

The slide bearing may be formed as a low cost, one-piece molded synthetic resin element.

The slide bearing may be secured to the ram assembly by a snap fastening means. In the illustrated embodiment, the slide bearing is provided with outwardly projecting flanges adapted to be received in suitable slots in the ram assembly for facilitated securing of the slide bearing to the ram assembly. The flanges may comprise L-shaped turned flanges providing facilitated snap fitting thereof to the ram assembly when inserted through the slots thereof. The flanges preferably extend in their elongated direction parallel to the direction of movement of the ram assembly to provide an improved strong, secured mounting of the slide bearings to the ram assembly.

The slide bearing elements of the present invention are extremely simple and economical of construction while yet providing an improved, low cost means for slidably guiding movement of a movable member relative to elongated guides and more specifically, is advantageously adapted for improved guiding of a ram assembly in a refuse compactor in its movement toward and from the compacting position on the compactor guides.

BRIEF DESCRIPTION OF THE DRAWING

Other features and advantages of the invention will be apparent from the following description taken in connection with the accompanying drawing wherein:

FIG. 1 is a side elevation of a refuse compactor utilizing slide bearings embodying the invention;

FIG. 2 is a fragmentary perspective view illustrating the arrangement of the ram assembly and guide frame structure with the slide bearings of the invention carried on the ram assembly for slidable engagement with guide portions of the frame structure;

FIG. 3 is a transverse section taken substantially along the line 3—3 of FIG. 2;

FIG. 4 is a fragmentary enlarged perspective view illustrating in greater detail the mounting of the slide bearing of the invention on the ram assembly;

FIG. 5 is a front elevation of the slide bearing;

FIG. 6 is a top plan view thereof;

FIG. 7 is a vertical section taken substantially along the line 7—7 of FIG. 5; and FIG. 8 is a vertical section taken substantially along the line 8—8 of FIG. 6.

DESCRIPTION OF THE PREFERRED EMBODIMENT

In the exemplary embodiment of the invention as disclosed in the drawing, a refuse compactor generally designated 10 is shown to include an outer cabinet 11 and a movable receptacle 12 in the form of a drawer defining a compacting space 13 when the drawer is moved into the cabinet 11 from the access position of FIG. 1. As illustrated in FIG. 2, the compactor further includes a ram assembly generally designated 14 which is slidably guided on guide corner portions 15 of a frame 16 within the outer cabinet 11. In the illustrated embodiment, four right angularly arranged guide corner portions 15 are provided on frame 16 for cooperating with a plurality of slide bearings generally designated 17 carried on the ram assembly in slidably guiding the ram in vertically reciprocal movement downwardly into compacting position within the drawer space 13 and upwardly therefrom to a retracted position above the drawer, permitting the drawer to be moved to the access position of FIG. 1 when desired.

The invention is concerned with an improved construction for such slide bearings. The use of the slide bearings in the refuse compactor is illustrative only, it being understood that the slide bearing structure is adapted for use in a wide range of applications as will be obvious to those skilled in the art.

As illustrated in FIGS. 2 and 3, the ram assembly is forcibly moved between the retracted and compacting positions by means of a pair of threaded power rods 18 which are suitably rotated about fixed axes so as to thread through nut devices 19 carried on a top portion 20 of the ram assembly 14. As further seen in FIGS. 2 and 3, the ram assembly defines four corner portions generally designated 21 which extend in slightly inwardly spaced relationship to the guide corners 15 of frame 16. The slide bearings 17 are mounted to the ram corner portions 21 for slidably engaging the guide corner portions 15 and thereby providing facilitated sliding movement of the ram assembly in the frame guides.

As indicated above, the invention comprehends an improved construction of the slide bearings 17. Each of the slide bearings 17 is similar and, thus, the description relative to the showing of the slide bearings in FIGS. 4–8 is pertinent to each of the slide bearings shown in FIG. 3. More specifically, as seen in FIG. 4, the slide bearing comprises a one-piece element having a base portion generally designated 22 defining a first leg 23 and a second leg 24. As shown in FIG. 4, the legs 23 and 24 extend angularly to each other. As best seen in FIG. 6, the angular extension is slightly greater than 90° so that the legs are retained against the right angularly extending surfaces 25 and 26 of the ram assembly corner 21 under a slight pressure. In the illustrated embodiment, the angularity is in the range of approximately 95° to 98°. The angularity is imparted by suitably arranging the configuration of a hinge portion 27 of base portion 22 at such an over-formed angle.

The slide bearing is preferably formed of a molded synthetic resin, such as nylon, and the hinge portion 27 may be effectively molded at the desired overformed angle.

As further illustrated in FIG. 4, the ram assembly corner may be provided with a first vertically elongated slot 28 opening through surface 25 and a second vertically elongated slot 29 opening through surface 26. The distal edge of the slide bearing leg 23 is provided with a rearwardly extending turned flange 30 and the distal end of the leg 24 is provided with a rearwardly extending turned flange 31. At least one of the flanges 30 and 31 defines an L-section and in the embodiment as illustrated in FIG. 6, flange 30 defines an L-section. To ensure that flange 31 is frictionally engaged with the edge of slot 29, a pair of spaced protrusions 40 are provided on bearing leg 23, as shown in FIGS. 5 and 6. When the slide bearing 17 is snapped in place on the ram assembly corner 21, the protrusions 40 bear against surface 25 of the ram assembly and urge flange 31 into the desired frictional engagement with slot 29. Thus, the flanges effectively cooperate with the slots in defining snap fastening means for retaining the slide bearing on the surfaces 25 and 26, as illustrated in FIG. 4.

As the direction of elongation, or maximum dimension, of the flanges 30 and 31 is in the direction of movement of the ram along the guide portions 15, maximum strength of retention is provided, though the flanges are relatively thin.

The slide bearing further defines a pair of resilient slide surface portions including a first such portion 32 comprising a tongue connected to the base portion leg 23 by a resilient connecting portion 33. Leg 24 of the slide bearing defines a second tongue 34 connected to the base portion thereof by a resilient connecting portion 35.

As further illustrated in FIG. 4, the second leg 24 may be provided with a third tongue 36 connected to the base portion 22 by a resilient connecting portion 37. Each of the tongues is caused to extend in offset relationship to the base portion 22 so as to extend therefrom into sliding engagement with the confronting surface of the frame guide portion 15, as illustrated in FIG. 3. As further shown in FIGS. 2, 3 and 4, tongues 32 face in a front-to-back direction of the compactor, aligned parallel to the centerline plane 38 of the axes of the power screw 18, as illustrated in FIG. 3. It has been determined that the loads on the ram assembly guides are greater in a front-to-back direction relative to the power screw axial plane than in a side-to-side direction parallel to the plane. Thus, as shown in FIG. 4, the surface area of tongue 32 and the width thereof is preferably made substantially greater than the surface area and the width of the tongues 34 and 36 which, as discussed above, normally need to accommodate lesser pressure forces in the sliding movement of the ram assembly on the guides.

By virtue of the offset projection of the tongues toward the space defined by the corner surfaces 25 and 26, substantial manufacturing tolerances can be accommodated while yet assuring an effective, freely sliding movement of the ram assembly on the frame guides. The extension of the tongues 32 and 34 from their connecting portions in a direction parallel to the direction of ram assembly movement effectively minimizes the possibility of breakage of the slide bearings. Further, as tongue 32 is generally arcuate, as illustrated in FIG. 7, the tongue may be readily slidably urged by the guide in either direction of movement of the ram assembly. Similarly, the extension of the lower tongue 36 in the downward direction facilitates sliding action during movement of the ram assembly to the retracted position.

In the illustrated embodiment, the tongues are under slight compressive pressure in the installed arrangement, such as shown in FIG. 3. Thus, the one-piece slide bearing effectively accommodates a wide range of tolerances both in the front-to-back and side-to-side direction between the ram assembly and the ram guide means. As the ram assembly and frame 16 may be defined by formed sheet metal structures, substantial economy is obtained by eliminating the need to maintain precise manufacturing tolerances in the forming processes.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a ram assembly, moving means for moving the ram assembly alternatively toward and from a compacting position, and guide means extending in the direction of movement of the ram assembly for guiding the ram assembly, said guide means including a first guide facing in a first direction transversely to said direction of movement of the ram assembly and a second guide facing substantially perpendicularly to said first guide in a second direction transversely to said direction of movement, the improvement comprising a one-piece bearing disposed between said ram assembly and said guide means and having a first base portion fixed to said ram assembly and a first slide portion carried by said first base portion for slidably engaging said first guide, and a second base portion fixed to said ram assembly and a second slide portion carried by said second base portion for slidably engaging said second guide, at least one of said slide portions being resiliently carried by a base portion.

2. In a refuse compactor having a ram assembly, moving means for moving the ram assembly alternatively toward and from a compacting position, said ram assembly defining a right angular bearing mounting portion, and a right angle guide extending longitudinally in the direction of movement of the ram assembly for guiding the ram assembly, including a first leg facing in a first direction transversely to said direction of movement of the ram assembly and a second leg facing substantially perpendicularly to said first leg in a second direction transversely to said direction of movement, the improvement comprising a one-piece bearing having a first base portion fixed to said ram assembly and a first slide portion resiliently carried by said first base portion for slidably engaging said first guide leg, and a second base portion fixed to said ram assembly and a second slide portion extending perpendicularly to said first slide portion and being resiliently carried by said second base portion for slidably engaging said second guide leg, said bearing base portions being mounted in right angularly extending relationship on said right angular bearing mounting portion of the ram assembly.

3. For use with a refuse compactor having a ram assembly, moving means for moving the ram assembly alternatively toward and from a compacting position, and guide means extending in the direction of movement of the ram assembly for guiding the ram assembly movement, said guide means including a first guide facing in a first direction transversely to said direction of movement of the ram assembly and a second guide disposed angularly with respect to said first guide and facing in a second direction transversely to said direction of movement, an improved slide bearing comprising a one-piece bearing on said ram assembly having a first base portion fixed to said ram assembly and a first, generally arcuate, slide portion resiliently carried by said first base portion for slidably engaging said first guide and a second base portion fixed to said ram assembly and a second slide portion being resiliently carried by said second base portion for slidably engaging said second guide.

4. The refuse compactor structure of claims 1, 2 or 3 wherein at least one of said slide portions is elongated in said direction of movement of the ram assembly.

5. The refuse compactor structure of claims 1, 2 or 3 wherein said slide portions are elongated in said direction of movement of the ram assembly.

6. The refuse compactor structure of claims 1, 2 or 3 wherein at least one of said slide portions comprises a tongue having a free distal end projecting in a direction parallel to the path of ram movement.

7. The refuse compactor structure of claims 1, 2 or 3 wherein said slide portions comprise tongues each having a free distal end projecting in a direction parallel to the path of ram movement.

8. The refuse compactor structure of claims 1, 2 or 3 wherein said slide portions comprise tongues each having a free distal end projecting in a direction parallel to the path of ram movement, and at least one of said slide portions including a second tongue having a free distal portion projecting in the opposite direction along the path of ram movement.

9. The refuse compactor structure of claims 1, 2 or 3 wherein said bearing and ram assembly are provided with cooperating interlock means for securing the bearing to said ram assembly.

10. The refuse compactor structure of claims 1, 2 or 3 wherein said bearing and ram assembly are provided with cooperating interlock means for securing the bearing to said ram assembly, said interlock means comprising structural portions defining slots extending in said direction of movement of the ram assembly and complementary projections extending into said slots.

11. A one-piece slide bearing comprising:

a base portion defining a first leg and a second leg extending angularly thereto;

a first tongue having a connecting portion resiliently connected to said first leg, and a slide portion offset from said first leg; and a second tongue having a connecting portion resiliently connected to said second leg, and a slide portion offset from said second leg, said offset portions of the tongues extending toward a common space defined by said legs.

12. A one-piece slide bearing comprising:

a base portion defining a first leg and a second leg extending angularly thereto;

a first tongue having a connecting portion resiliently connected to said first leg, and a slide portion offset from said first leg;

a second tongue having a connecting portion resiliently connected to said second leg, and a slide portion offset from said second leg, said offset portions of the tongues extending toward a common space defined by said legs; and fastener means projecting from said legs for use in securing the slide bearing to a mounting element.

13. The one-piece slide bearing of claims 11 or 12 wherein a third offset tongue is provided on said second leg extending oppositely to said second tongue.

14. The one-piece slide bearing of claims 11 or 12 wherein a third offset tongue is provided on said second leg extending oppositely to said second tongue, said third tongue being offset from said second leg similarly as said second tongue.

15. The one-piece slide bearing of claims 11 or 12 wherein said slide portion of the first tongue defines an area substantially greater than the area of said slide portion of the second tongue.

16. The one-piece slide bearing of claims 11 or 12 wherein the width of said slide portion of the first tongue is substantially greater than the width of the slide portion of the second tongue.

17. The one-piece slide bearing of claims 11 or 12 wherein said base portion defines a resilient hinge connecting the angularly related legs.

18. The one-piece slide bearing of claim 12 wherein said fastener means comprises turned flanges.

19. The one-piece slide bearing of claim 12 wherein said fastener means comprises turned flanges at least one of which defines an L-section.

20. The one-piece slide bearing of claim 12 wherein said fastener means comprises a turned flange formed integrally with each of said legs and connected thereto along an axis extending in the direction of extension of said tongues.

* * * * *